United States Patent [19]

Miyazaki et al.

[11] Patent Number: 4,967,717

[45] Date of Patent: Nov. 6, 1990

[54] ABNORMALITY DETECTING DEVICE FOR AN EGR SYSTEM

[75] Inventors: Masaaki Miyazaki; Hajime Kako, both of Himeji, Japan

[73] Assignee: Mitsubishi Denki Kabushiki Kaisha, Tokyo, Japan

[21] Appl. No.: 271,968

[22] Filed: Nov. 16, 1988

[30] Foreign Application Priority Data

Nov. 20, 1987 [JP] Japan ..... 62-294567
Dec. 24, 1987 [JP] Japan ..... 62-332679
Dec. 24, 1987 [JP] Japan ..... 62-332680

[51] Int. Cl.[5] ..... F02M 25/07
[52] U.S. Cl. ..... 123/571
[58] Field of Search ..... 123/568, 569, 570, 571, 123/479; 364/431.06

[56] References Cited

U.S. PATENT DOCUMENTS 4,462,376 7/1984 Ripper et al. ..... 123/571
4,770,146 9/1988 Shibata et al. ..... 123/571
4,793,318 12/1988 Tsurusaki ..... 123/571
4,794,903 1/1989 Suzuki ..... 123/571
4,834,054 5/1989 Hashimoto et al. ..... 123/571

FOREIGN PATENT DOCUMENTS 0031886 7/1977 Japan .

*Primary Examiner*—Willis R. Wolfe
*Attorney, Agent, or Firm*—Sughrue, Mion, Zinn, Macpeak & Seas

[57] ABSTRACT

A detecting device for detecting abnormality in an EGR system comprises an EGR valve disposed in an EGR passage to control a flow rate of recirculated exhaust gas, a first temperature sensor disposed in the EGR passage to detect the temperature of the same, a second temperature sensor disposed in the air-intake passage of an engine, an EGR abnormality determining zone discriminating means to discriminate a specified operational zone in an operable area for the engine in which recirculation of the exhaust gas is controlled by the EGR valve. Abnormality in the EGR system is detected on the basis of a value obtained by comparison of the output of the first and second temperature sensors in the specified operational zone.

7 Claims, 10 Drawing Sheets

ABNORMALITY DETECTING DEVICE FOR AN EGR SYSTEM

BACKGROUND OF THE INVENTION

1. Field of the Invention

The present invention relates to a device for detecting an abnormal condition in an EGR system installed in an internal combustion engine.

2. Discussion of Background

Heretofore, a conventional device of this kind is so adapted that an output from an EGR temperature sensor provided in an EGR passage is compared with a predetermined value under a specified condition of operation of an internal combustion engine in which exhaust gas is recirculated, i.e. an EGR operation is carried out. When an unusual state such as the clogging of the EGR passage takes place, the fact that the output of the EGR temperature sensor becomes the predetermined value is detected, whereby abnormality in the EGR system is detected.

SUMMARY OF THE INVENTION

However, the conventional abnormality detecting device has such a problem that the output of the EGR temperature sensor is apt to be influenced by the temperature of the outer air, so that when the outer air has a lower temperature, a temperature for detection is decreased, thus causing erroneous detection of an abnormality in the EGR operation. In order to minimize such erroneous detections, detection of abnormality is conducted in a region of a large flow rate where the output of the EGR temperature sensor is sufficiently high in temperature. Accordingly, the conventional abnormality detecting device was insufficient to detect a phenomenon such as the clogging of the EGR passage with high accuracy, which is an important factor in purifying the exhaust gas.

It is an object of the present invention to provide an abnormality detecting device which is capable of detecting abnormality in an EGR system with high accuracy without an influence by the temperature of the outer air.

In one aspect of the present invention, there is provided a detecting device for detecting abnormality in an EGR system which comprises an EGR valve disposed in an EGR passage to control a flow rate of recirculated exhaust gas, a first temperature sensor disposed in the EGR passage to detect the temperature thereof, a second temperature sensor disposed in the air-intake passage of an engine, an EGR abnormality determining zone discriminating means to discriminate a specified operational zone in an operable area for the engine in which recirculation of the exhaust gas is controlled by the EGR valve, and an abnormality determining means to determine abnormality in the EGR system depending on a value obtained by comparison of the output of the first and second temperature sensors in the specified operational zone.

In another aspect of the present invention, there is provided a detecting device for detecting abnormality in an EGR system which comprises an engine provided with an EGR system. The EGR system includes an EGR valve to control a flow rate of exhaust gas to be recirculated to an air intake pipe, an EGR temperature sensor disposed in an exhaust gas recirculation passage in the EGR system, and an abnormality determining condition detecting means which measures a time period in which an operational condition of the engine is within a specified zone which stabilizes recirculation of the exhaust gas in the EGR system. The abnormality determining condition detecting means stops the measurement of the time period when the operational condition is out of the specified zone and this out zone condition is within a first predetermined time, and detects whether a time obtained by accumulation of the measurement exceeds a second predetermined time. The EGR system also includes an abnormality determining means to detect abnormality in the EGR system on the basis of an output of the EGR temperature sensor when a detection output is received from the abnormality determining condition detecting means.

In another aspect of the present invention, there is provided a detecting device for detecting abnormality in an EGR system which comprises an engine provided with an EGR system comprising an EGR valve to control a flow rate of exhaust gas to be recirculated in a recirculation passage in the EGR system, and an abnormality determining condition detecting means which measures a time period in which an operational condition for the engine is within a specified zone which stabilizes a recirculation of the exhaust gas in the EGR system. The time period is obtained by the measurement being reduced depending on a time in a first predetermined time period when the operational condition of the engine is out of the specified zone and this out-zone condition is within the first predetermined time period. The abnormality determining condition detecting means also detects whether the time period obtained by the measurement exceeds a second predetermined time period. An abnormality determining means detects abnormality in the EGR system on the basis of an output of the EGR temperature sensor when a detection output is received from the abnormality determining condition detecting means.

BRIEF DESCRIPTION OF THE DRAWINGS

A more complete appreciation of the invention and many of the attendant advantages thereof will be obtained readily as the invention becomes better understood by reference to the following detailed description when considered in connection with the accompanying drawings, wherein.

DETAILED DESCRIPTION OF PREFERRED EMBODIMENTS

Preferred embodiments of the abnormality detecting device of the present invention will be described with reference to the drawings.

Figure 1:
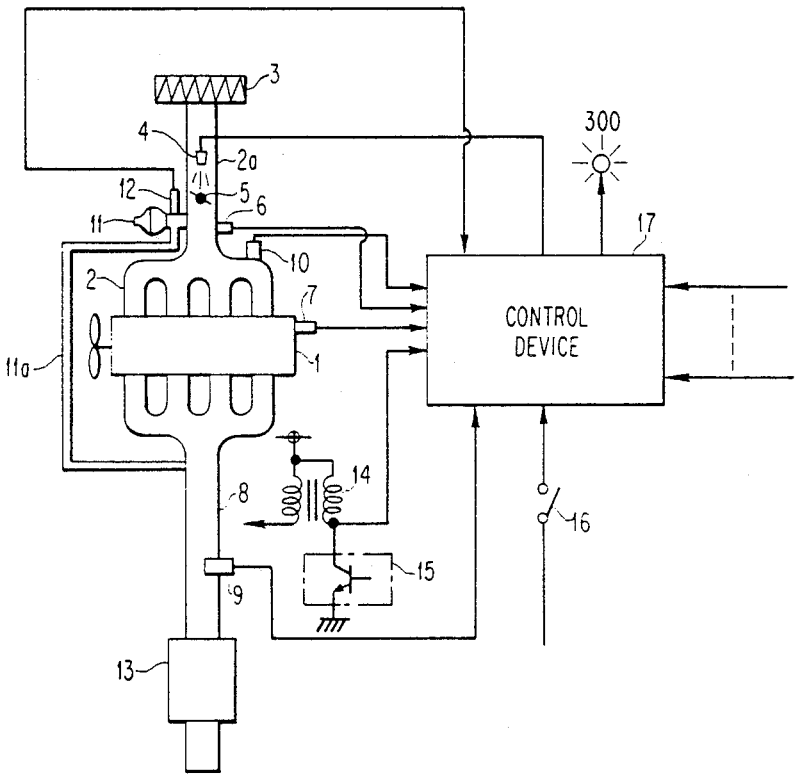
FIG. 1 is a diagram of an embodiment of the abnormality detecting device according to the present invention.

FIG. 1 shows an embodiment of the present invention. An engine 1 mounted on an automobile has an intake manifold 2. An intake air pipe 2*a*is connected to the port at the upper stream side of the intake manifold, and an air cleaner 3 is attached to the inlet port of the intake air pipe 2*a*. An injector 4 injects fuel in the intake manifold 2. A throttle valve 5 adjusts a quantity of air sucked into the engine 1, and a pressure sensor 6 detects a negative pressure at the downstream side of the throttle valve 5 as an absolute pressure value. A cooling water temperature sensor 7 detects a temperature of cooling water for the engine 1. An air-fuel ratio sensor 9 detects a concentration of oxygen in the exhaust gas flowing in an exhaust manifold 8 of engine 1, and an intake air temperature sensor 10 is attached to the intake manifold 8. An EGR valve 11 recirculates exhaust gas flowing in the exhaust manifold 8, the EGR valve 11 being controlled to be open depending on a negative pressure of the intake air around the throttle valve 5. An EGR passage 11*a* allows the exhaust manifold 8 to communicate with the downstream side of the throttle valve 5 in the intake air pipe 2*a* via EGR valve 11. An EGR temperature sensor 12 is disposed in an EGR passage, and a ternary component catalyst 13 purifies the exhaust gas. An ignition coil 14 supplies a high voltage to an ignition plug (not shown) in the engine 1, and an igniter 15 feeds a current to the ignition coil 14. A cranking switch 16 is connected to a control device 17 which is adapted to receive signals indicating various parameters of the engine and to perform various determinations of the operations. As such, a quantity of fuel to be supplied to the engine is controlled and abnormality in the EGR system is judged. A display lamp 300 indicates abnormality of the EGR system.

Figure 4:
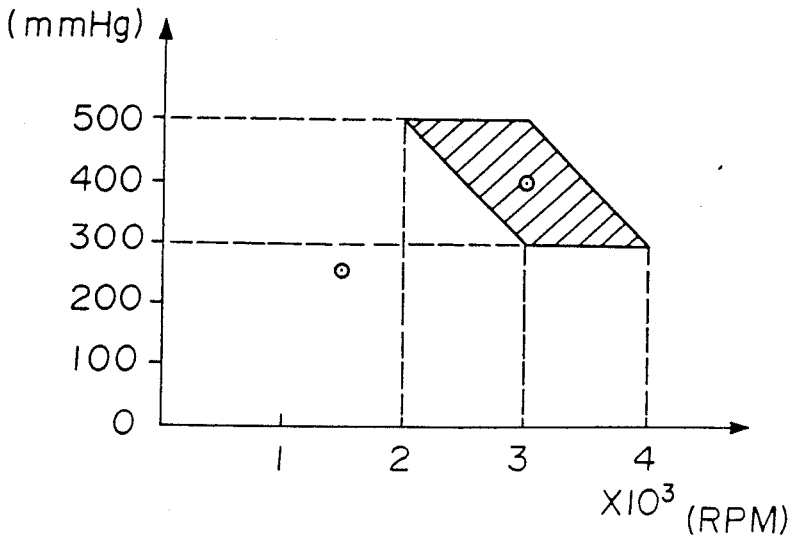
FIG. 4 is a diagram illustrating a zone to determine abnormality in an EGR system.

FIG. 4 is a graphical representation showing an EGR abnormality determining zone which is determined by the parameters of an engine revolution number $N_E$ and a pressure in the intake manifold P, and which determines whether or not there is an abnormal state in the EGR system. In FIG. 4, a hatched portion represents a zone in which a stable recirculation of the exhaust gas is obtainable. The data of the engine revolution number $N_E$ and the pressure P stored previously in a read only memory in a form of a map.

An embodiment of the inner structure of the control device 17 will be described with reference to FIGS. 2 and 3.

Figure 2:
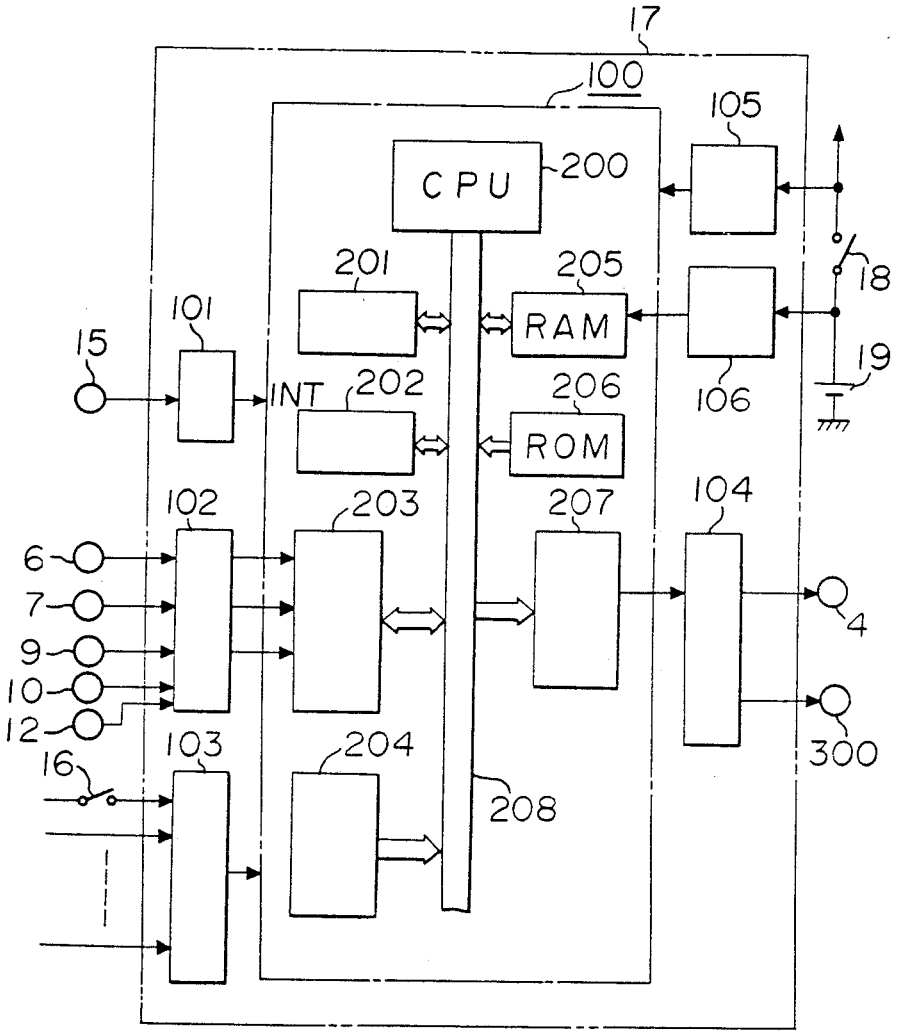
FIG. 2 is a block diagram showing a construction of the control device shown in FIG. 1.
Figure 3:
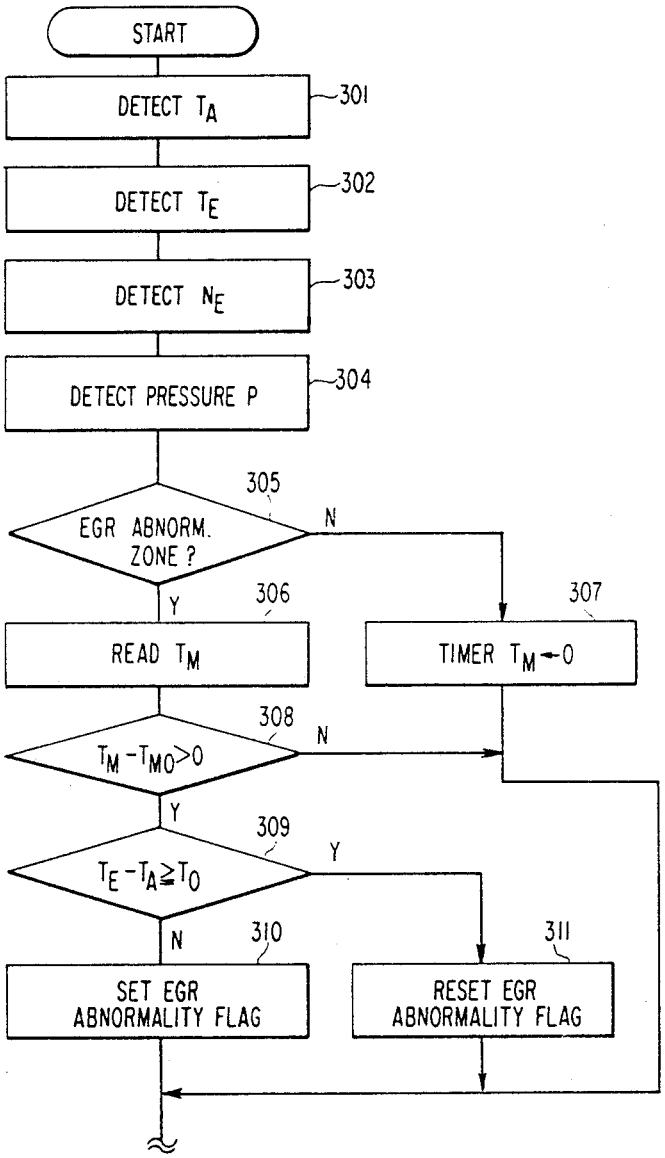
FIG. 3 is a flow chart showing an example of the operation of a CPU in the control device shown in FIG. 1.

In FIG. 2, a microcomputer 100 includes a CPU 200 to execute a flow of steps as shown in FIG. 3, a counter 201, a timer 202, an A/D transducer 203 for transforming an analogue signal into a digital signal, an input port 204 to receive digital signals, a non-volatile RAM 205 which functions as a work memory and stores values obtained by learning, an ROM 206 storing the flow of steps as shown in FIG. 3 as a form of a program, an output port 207 to output signals indicating a quantity of fuel to be ejected which is obtained by arithmetic calculations and a signal of abnormality in the EGR system, and a common bus 208 for connecting the above-mentioned structural elements.

The control device 17 is provided with a first input interface circuit 101 which is connected to the collector of a transistor in the ignitor 15 which is, in turn, connected to the ignition coil 14, and supplies a signal indicative of, for instance, an engine revolution number $N_E$ to the microcomputer 100. Control device 17 is provided further with a second input interface cicuit 102 to input analogue output signals from the pressure sensor 6, the cooling water temperature sensor 7, and and the air-fuel ratio sensor 9 to the A/D transducer 203. Also included are a third input interface circuit 103 to input the other various signals such as a signal from the cranking switch 16 to the microcomputer 100, an output interface circuit 104 which outputs a signal indicative of a quantity of fuel to be ejected which is output from the output port 207, to the injector 4 in a form of a pulse having a time width and outputs a driving signal to drive the display lamp 300 in correspondence to an EGR abnormality indicating signal. Control device 17 also is provided with a first power source circuit 105 which is connected to the battery 106 via a key switch 18 to supply power to the microcomputer 100 and a second power source circuit 106 connected to the battery 19 thereby to prevent data stored in the RAM 205 from being erased.

The operation of the control device will be described hereinafter.

Intake air is sucked into the engine 1 through the intake air pipe 2*a* and the intake manifold 2 together with fuel ejected from the injector 4 via the air cleaner 3 at an appropriate flow rate corresponding to a degree of opening of the throttle valve 5. On the other hand, a degree of opening of the EGR valve 11 is adjusted on the basis of a pressure difference between an atmospheric pressure and a negative pressure at the downstream side of the throttle valve 5 so that the exhaust gas is recirculated in the intake air pipe 2*a* through the EGR passage 11*a* via the exhaust manifold 8 when the EGR valve 11 is opened and the exhaust gas is sucked into the engine 1 together with the intake air. After the intake process is performed, compression, combustion and exhaustion processes are carrried out in the engine 1. At the time of ignition, the ignitor 15 is controlled from a turning on state a turning off state so that the ignition coil applies a high voltage to the ignition plug (not shown).

Below, operations executed by the CPU 200 in the microcomputer 100 will be described.

When the key switch 18 is turned on, a voltage is applied to the first power source circuit 105 from the battery 19. The first power source circuit supplies a fixed voltage (5 V) to the microcomputer 100 thereby to start the operation of the control device 17. Then, a flow for the main routine (not shown) is carried out, whereby a quantity of fuel to be ejected to the engine is calculated.

On the other hand, the flow of the main routine is interrupted at each time of one revolution of the engine, and an interruption routine as shown in FIG. 3 is executed.

An output $T_A$ from the intake air temperature sensor and an output $T_E$ from the EGR temperature sensor are read by the CPU 200 via the second input interface circuit 102 and the A/D transducer 203 at a Step 301 and a Step 302, respectively.

At a Step 303, variations of a signal from the ignitor 15 obtained at the time of feeding a current to the ignition coil 14 are inputted to the CPU 200 through the first input interface circuit 101, and a time period from the previous ignition to the present ignition is measured by the timer 202 so that a revolution number $N_E$ of the engine 1 is calculated on the basis of the above mentioned measured data.

At a Step 304, a pressure P in the intake manifold is read through the pressure sensor 6, the second input interface circuit 102, and the A/D transducer 203.

At a Step 305, judgement is made as to whether or not the operational condition falls within the EGR abnormality determining zone indicated by hatching in FIG. 4 on the basis of the engine revolution number $N_E$ and the pressure P in the intake manifold which were read at the Steps 303 and 304 302. The hatched zone is determined to be a specified region where the EGR valve 11 is opened. When an operational condition determined by the engine revolution number $N_E$ and the pressure P falls in the hatched zone, a value $T_M$ of time is read at a Step 306. When the condition does not fall in the hatched zone, the value $T_M$ measured by a timer is reset at a Step 307. Accordingly, the timer measures a time when the operational condition of the engine is in the hatched zone.

At a Step 308, the value $T_M$ measured by the timer is compared with a time $T_{MO}$ required to stabilize the operation of the EGR temperature sensor 12. When $T_M > T_{MO}$, then, a Step 309 is performed.

Figure 6:
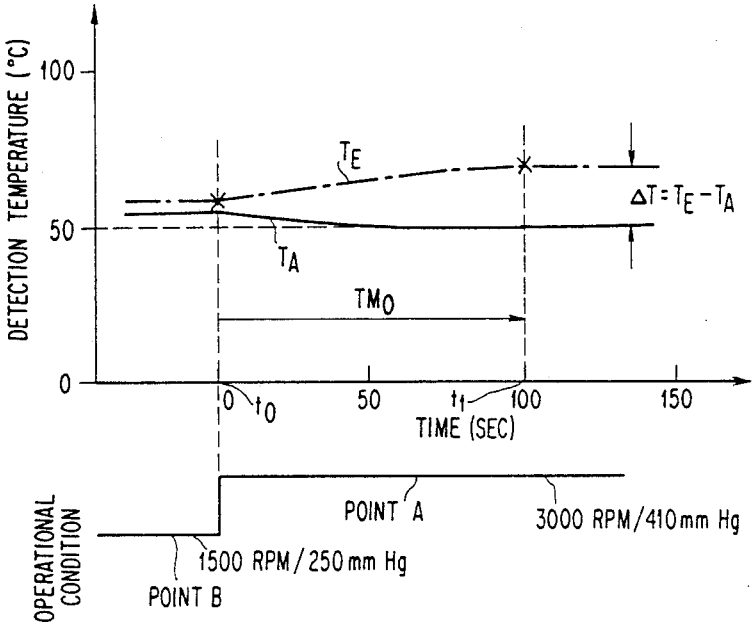
FIG. 6 is a diagram showing a transient characteristic of the outputs of the EGR temperature sensor and the intake air temperature sensor when the operational conditions of an engine change.

FIG. 6 the transient characteristics of the output $T_A$ of the intake air temperature sensor and the output $T_E$ of the EGR temperature sensor 12 when the operational condition is moved from a point B (1,500 RPM, 250 mmHg) other than the EGR abnormality determining zone to a point A (3,000 RPM, 410 mmHg) which falls in the EGR abnormality determining zone. At the point B, there is no EGR, and the output $T_E$ of the EGR temperature sensor indicates a value near the output $T_A$ of the intake air temperature sensor. However, at the point A, the output $T_E$ of the EGR temperature sensor gradually increases in comparison with the output $T_A$ of the intake air temperature sensor by the EGR.

At a Step 309, the output $T_A$ of the intake air temperature sensor 10 is compared with the output $T_E$ of the EGR temperature sensor 12. When $T_E - T_A \geqq T_O$ ($T_O$ is a specified value), namely, when $T_E$ is greater than $T_A$ by $T_O$ or more, an EGR abnormality flag in the RAM 205 is reset at a Step 311. On the other hand, when $T_E - T_A < T_O$, the EGR abnormality flag is set at a Step 310, whereby the abnormality display lamp is operated via the output port 207 and the output interface circuit 104.

Figure 5:
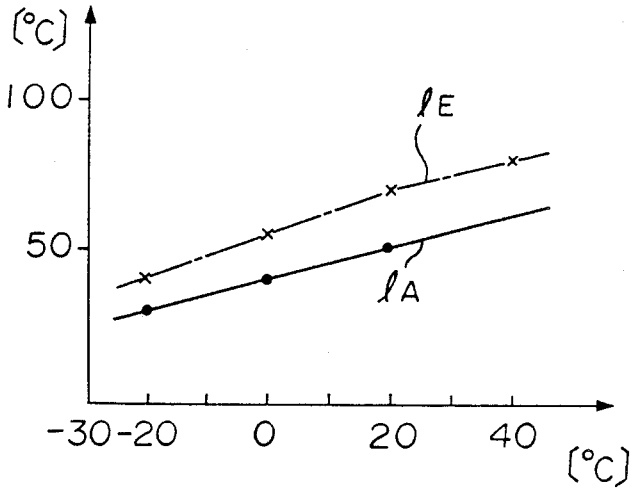
FIG. 5 is a characteristic diagram showing the outputs of an EGR temperature sensor and an intake air temperature sensor.

Generally, the output $T_E$ of the EGR temperature sensor 12 is apt to be influenced by the temperature of the outer air as shown in FIG. 5, and the output $T_E$ decreases as the outer temperature decreases. Also, the output $T_A$ of the intake air temperature sensor 10 decreases as the outer temperature decreases. Accordingly, a value of $T_E - T_A$ is a function of a flow rate of recirculated exhaust gas without suffering an influence by the outer air temperature. Accordingly, the flow rate of EGR can be detected by the magnitude of the value $T_E - T_A$.

Therefore, abnormality in the EGR system can be detected when the flow rate of EGR is lower than a specified value.

Thus, in the above-mentioned embodiment of the present invention, an abnormal state such as the clogging of the EGR passage is detected by discriminating the magnitude of a value which is obtained by comparing an output from the intake air temperature sensor attached to the intake air passage with an output from the EGR temperature sensor attached to the EGR passage. Accordingly, the abnormal state such as the clogging of the EGR passage can be detected without any influence by the outer air temperature.

Figure 7:
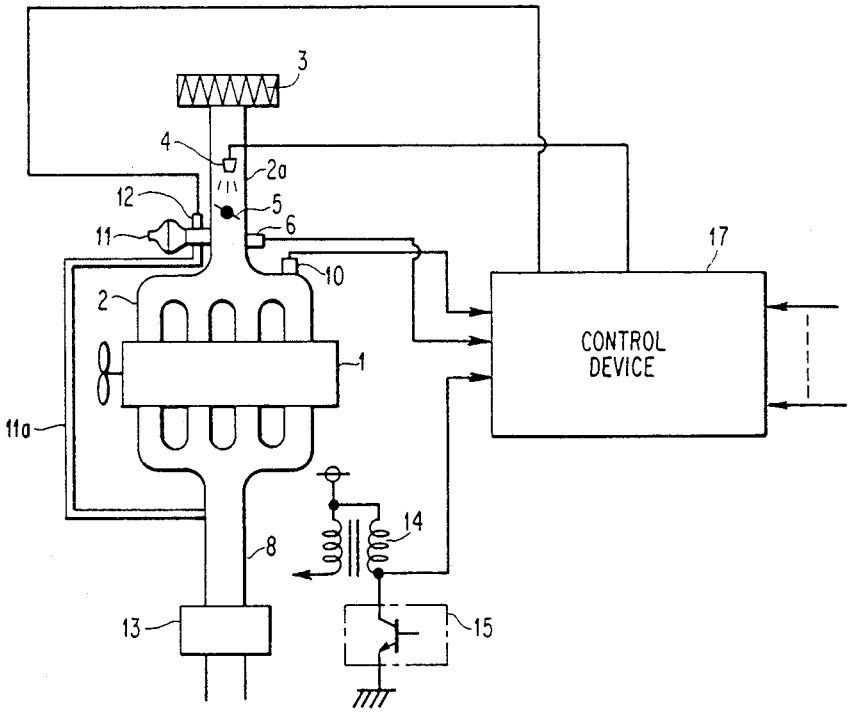
FIG. 7 is a diagram of another embodiment of the abnormality detecting device of the present invention.
Figure 8:
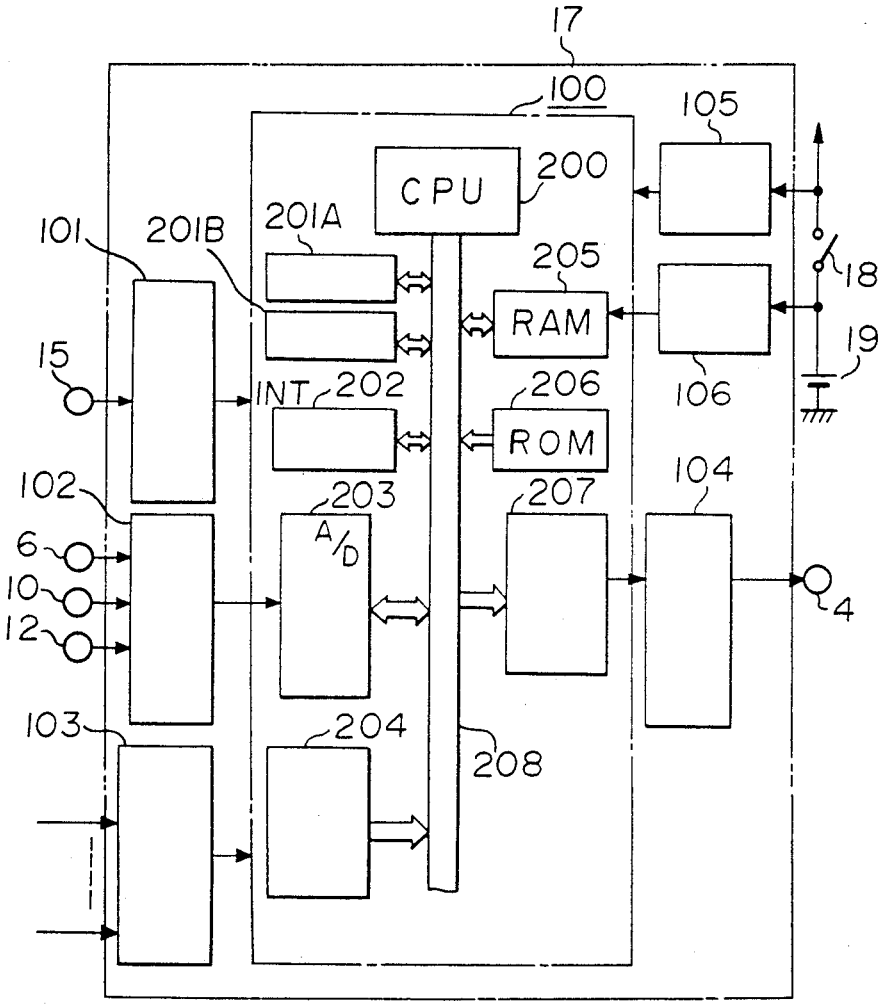
FIG. 8 is a block diagram showing a construction of the control device shown in FIG. 7.

A second embodiment of the abnormality detecting device of the present invention will be described with reference to FIGS. 7 to 10. In FIGS. 7 and 8, the same reference numerals as in FIGS. 1 and 2 designate the same or corresponding parts, and therefore, description of these parts and their functions is omitted.

The operation executed by the CPU 200 in the control device 17 in the second embodiment of the present invention will be described.

When the key switch 18 is turned on, a voltage is applied to the first power source circuit 105 by means of the battery 19. The first power source circuit 105 supplies a fixed voltage of 5 V to the microcomputer 100, whereby the control device 17 is actuated.

On initializing the control device 17, a value $TM_1$ in a first counter 201A as the first timer and a value $TM_2$ in a second counter 201B as the second timer are reset respectively to zero. An interruption routine is effected at every predetermined time from the actuation of the control device 17, and then, a flow of step of the interruption routine as shown in FIG. 9 is executed repeatedly.

Figure 9:
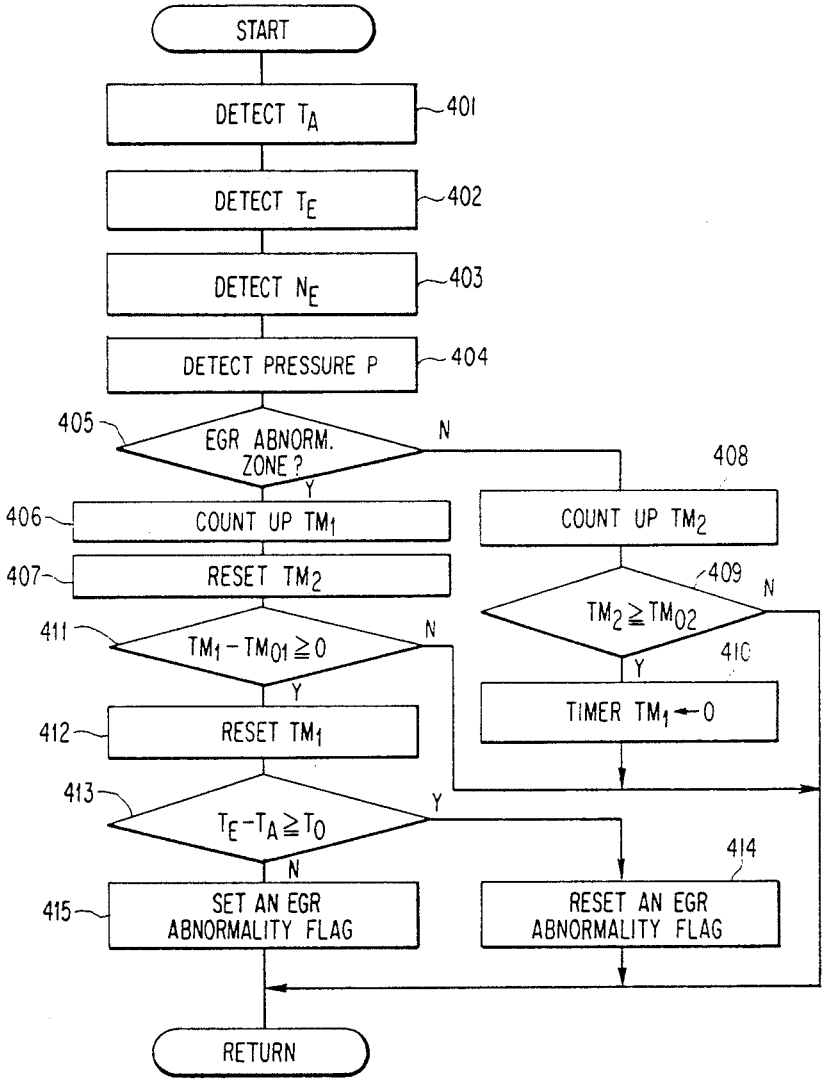
FIG. 9 is a flow chart showing the operation of a CPU in the control device shown in FIG. 7.

At a Step 401, as shown in FIG. 9, an output $T_A$ of the intake air temperature sensor 10 is read by the CPU 200 via the second input interface circuit 102 and the A/D transducer 203, and the read value is stored in the RAM 205.

At a Step 402, an output $T_E$ of the EGR temperature sensor 12 is read in the same manner as the output $T_A$, and the read value is stored in the RAM 205. At a Step 403, a revolution number $N_E$ of the engine is calculated on the basis of data measured by the timer 202 which counts a period of revolution of the engine 1, and the thus obtained value is stored in the RAM 205. An ignition signal of the ignitor 15 which produces the signal when it is changed from a turning-on state to a turning off state is inputted to the CPU 200 through the first input interface circuit 101, and the timer 202 counts a time from the previous ignition to the present ignition. At a Step 404, a pressure signal from the pressure sensor 6 which corresponds to a pressure P in the intake manifold, is read by the CPU 200 through the second input interface circuit 102 and the A/D transducer 203, and the value is stored in the RAM 205. At a Step 405, detected data of the engine revolution number $N_E$ and the pressure P in the intake manifold are taken from the RAM 205. Then, determination is made as to whether or not the engine revolution number $N_E$ and the pressure P respectively fall in the EGR abnormality determining zone indicated by hatching in FIG. 4, the determining zone being stored previously in the ROM 206. When they are within the EGR abnormality determining zone, the value $TM_1$ in the first timer is counted up for a specified time at a Step 406, and then, the value $TM_2$ in the second timer is reset at a Step 407.

On the other hand, when it is found that the engine revolution number $N_E$ and the pressure P in the intake manifold do not fall within the EGR abnormality determining zone at the Step 405, the value $TM_2$ in the second timer is counted up for a specified time at a step 408. Then, a determination is made as to whether or not the value $TM_2$ in the second timer is greater than a specified value $TM_{02}$ at a Step 409. Namely, a determination is made as to whether or not a specified time has passed in the region out of the EGR abnormality determining zone. When $TM_2 \geqq TM_{02}$ at the Step 409, the value $TM_1$ in the first timer is cancelled and the value $TM_1$ of the first timer is reset at a Step 410.

After the completion of the Step 407, a Step 411 is taken where a determination is made as to whether or not a value obtained by subtracting a specified value $TM_{01}$ from the value $TM_1$ in the first timer is zero or higher. Namely, a determination is made as to whether or not the engine revolution number $N_E$ and the pressure P in the intake manifold are continuously present for a specified time period or more in the EGR abnormality determining zone. When $TM_1 \geqq TM_{01}$, the value $TM_1$ of the first timer is reset at a Step 412. Then, an output $T_A$ of the intake air temperature sensor 10 is compared with an output $T_E$ of the EGR temperature sensor 12, both the outputs being read from the RAM 205 at a Step 413. When $T_E - T_A \geqq T_O$ ($T_O$ is a specified value), an EGR abnormality flag in the RAM 205 is reset at a Step 414. On the other hand, when $T_E - T_A < T_O$ at the Step 413, the EGR abnormality flag in the RAM 205 is set at a Step 415, whereby the fact that the EGR system is in an abnormal state is indicated.

After the determination that the value $TM_2$ of the second timer is smaller than the specified value $TM_{02}$ has been made at the Step 409, and the Step 410 has been finished and the determination that the value of $TM_1$ of the first timer is smaller than the specified value $TM_{01}$ has been made at the Step 411, the Step 414 or the Step 415 is carried out. Then, the main routine is performed again.

As described before the output $T_E$ of the EGR temperature sensor 12 is generally apt to be influenced by the temperature of the outer air as indicated by a line $l_E$ in FIG. 5. However, the output $T_A$ of the intake air temperature sensor 10 has also a tendency to decrease as indicated by a line $l_A$ as the temperature of the outer air decreases. Accordingly, a value of $T_E - T_A$ is a function of a flow rate of exhaust gas recirculated in the EGR system without an influence of the outer air temperature.

Figure 10:
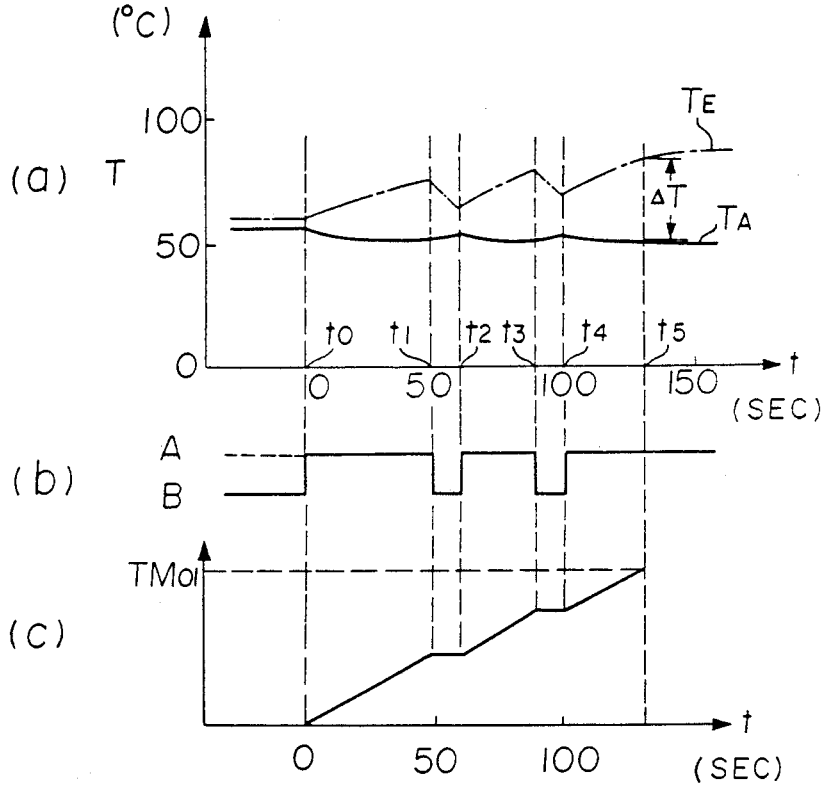
FIG. 10 is a timing chart showing a relation among a detected temperature, operational conditions, and a time in a first timer.

FIG. 10 is a diagram showing a relation between a detected temperature T with a lapse of time t, an operational condition, and variations in a value $TM_1$ in the first timer. In a time period from a time $T_0$ to a time period $T_1$ and a time from a time $T_2$ to a time $T_3$ and a time period from a time $T_4$ to a time $T_5$, the operational condition falls in the EGR abnormality determining zone (a level A in FIG. 10*b*) which is indicated by hatching in FIG. 4. Accordingly, the output $T_E$ of the EGR temperature sensor 12 increases as shown in FIG. 10*a* when the output $T_A$ of the intake air temperature sensor 10 is substantially constant. In the above-mentioned time periods, the first timer $TM_1$ counts up as shown in FIG. 10*c*. In the time period from the time $T_1$ to the time $T_2$ and the time period from the time $T_3$ to the time $T_4$, the output $T_E$ of the EGR temperature sensor 12 decreases due to a reduced flow rate of exhaust gas recirculated in the EGR system because the operational condition is out of the EGR abnormality determining zone (a level B in FIG. 10*b*) which is indicated by hatching in FIG. 4. In these time periods, counting up in the first timer (having a value $TM_1$) is not effected. Further, in these time periods, the counting-up is effected for the second timer (having a value $TM_2$). However, the second timer is reset because a counted value does not reach the value $TM_{02}$.

As shown in FIG. 10*c*. when a value $TM_1$ in the first timer reaches the predetermined value $TM_{01}$ at the time $t_5$, determination is made whether or not the value of $T_E - T_A = \Delta T$ shows the specified value $t_0$ or higher.

The value $\Delta T$ exceeds the specified value $t_0$ when the EGR system having the EGR passage 11*a* and EGR valve 11 is normally operating and a flow rate of exhaust gas in recirculation is sufficient. On the other hand, the value $\Delta T$ is lower than the specified value $t_0$ if a flow rate of exhaust gas in circulation is insufficient because EGR system is in an abnormal state such as when is clogged the EGR passage.

Thus, in the above-mentioned embodiment of the present invention, a time in which an operational condition for the engine is in the EG abnormality determining zone is measured continuously if the EGR temperature sensor is not affected substantially, and abnormality in the EGR system is judged on the basis of the output value of the EGR temperature sensor attached to the EGR passage when the measured time exceeds a predetermined time. Accordingly, abnormality in the EGR system can be detected at a high accuracy without any influence by the temperature of outer air. Hence, erroneous detection of the EGR system can be avoided.

A third embodiment of the present invention will be described hereinbelow. The entire construction of the internal combustion engine and the inner structure of the control device installed in the engine according to the third embodiment of the present invention are the same a those of the second embodiment provided that operations executed by the CPU in the control device are different.

The sequential operations by the CPU 200 will be described with reference to FIG. 11.

Figure 11:
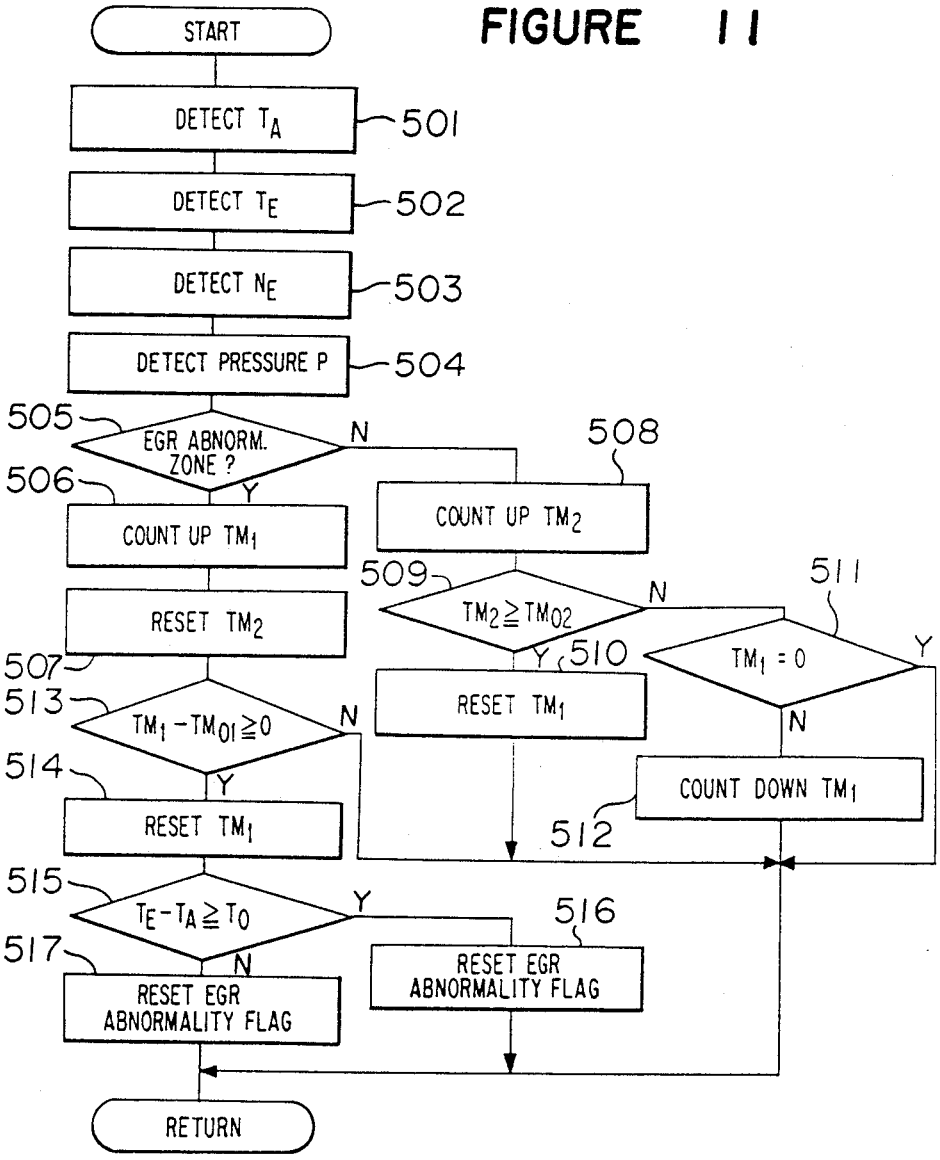
FIG. 11 is a flow chart showing the operation of a CPU in a control device in another embodiment of the present invention.

In FIG. 11, Steps 501–509 and Steps 513–517 are the same as the Steps 401–409 and the Steps 411–415 in FIG. 9.

As a result of determination as to whether or not the value $TM_2$ in the second timer is greater than the specified value $TM_{02}$ at the Step 509, when it is found that $TM_2 \geqq TM_{02}$, then, a Step 510 is taken, where a value $TM_1$ in the first timer is reset. On the other hand, when $TM_2 < TM_{02}$, determination is made as to whether or not a value $TM_1$ in the first timer is reset at a Step 511. When the value $TM_1$ in the first timer is not 0, namely, the first timer is not reset at the Step 511, the operation of counting-down of a specified time is effected for the value $TM_1$ in the first timer at a Step 512. After the value $TM_1$ in the first timer has been reset at the Step 510, followed by making the judgement that the value $TM_1$ is reset at the Step 511, then, the performance of the Step 512 has been finished, and then the judgement that the value $TM_1$ is smaller than the specified value $TM_{01}$ has been made, the treatment of the Step 516 or the Step 517 is carried out before the main routine is taken again.

Figure 12:
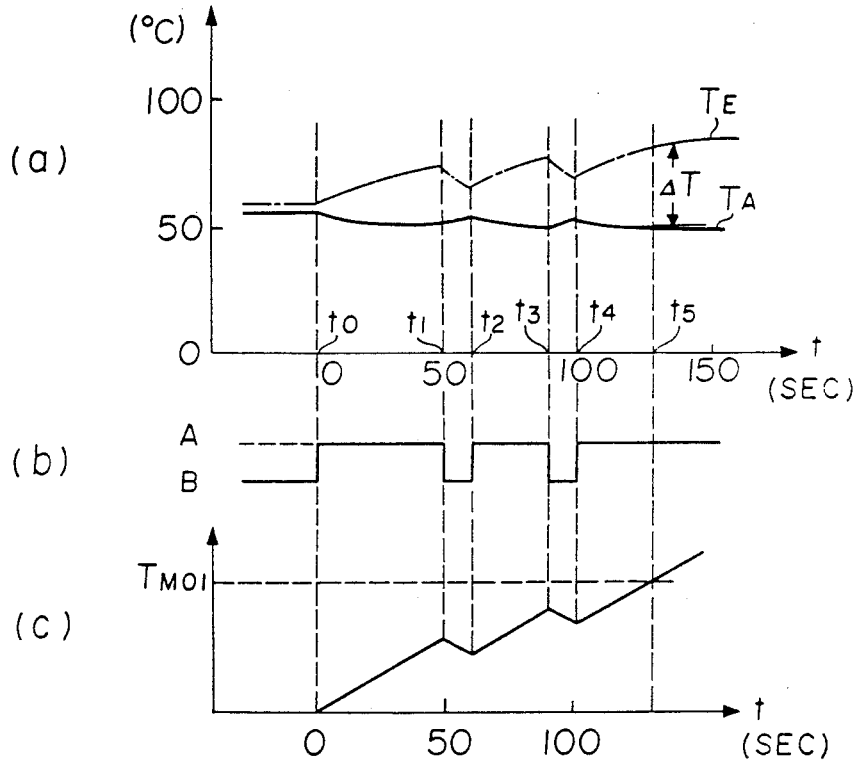
FIG. 12 is a timing chart showing a relation among a detected temperature, operational conditions, and a time of a first timer.

FIG. 12 is a diagram showing a relation between a detection temperature T with a lapse of time t, an operational condition, and the variations in a value $TM_1$ in the first timer. In a time point from a time $t_0$ to a time $t_1$, a time period from a time $t_2$ to a time $t_3$, and a time period from a time $t_4$ to a time $t_5$, the operational condition falls in the EGR abnormality determining zone (a level A in FIG. 12*b*) which is indicated by hatching in FIG. 4. Accordingly, the output $T_E$ of the EGR temperature sensor 12 increases as shown in FIG. 12*a* when the temperature of outer air is substantially constant and the output $T_A$ of the intake air temperature sensor 10 is substantially constant. In these time periods, the value $TM_1$ in the first timer is counted up. In the time period from $t_1$ to $t_2$ and the time period from $t_3$ to $t_4$, the operational condition is out of the EGR abnormality determining zone (a level B in FIG. 12*b*) which is indicated by hatching in FIG. 4. Accordingly, the output $T_E$ of the EGR temperature sensor 12 decreases as shown in FIG. 12*a* even though the temperature of outer air does not change. In these time periods, the first timer (having a value $TM_1$) is counted down so as to correspond to an amount of reduction of the output $T_E$.

As shown in FIG. 12*c*, when the value $TM_1$ in the first timer reaches the specified value $TM_{01}$ at the time point $t_5$, determination is made as to whether or not the value of $T_E - T_A = \Delta T$ is greater than the specified value $t_0$.

The value $\Delta t0$ becomes greater than the specified value $T_0$ when a flow rate of exhaust ga in recirculation is sufficient owing to a normal operation in the EGR system with the EGR passage 11*a* and the EGR valve 11. On the other hand, the value $\Delta t_0$ becomes smaller than the specified value $T_O$ unless a flow rate of exhaust gas in recirculation is sufficient due to an abnormal state in the EGR system.

Thus, in the third embodiment of the present invention, a time in which an operational condition for the engine is within the EGR abnormality determining zone is measured. When the operational condition is deflected from that zone, a time obtained by measuring is reduced, and abnormality in the EGR system is determined on the basis of the output of the EGR temperature sensor when a time obtained by measuring exceeds a specified time. Accordingly, abnormality in the EGR system can be detected at a high accuracy without an influence by the temperature of the outer air and without erroneous detection.

In the above-mentioned embodiments, the output of the EGR temperature sensor is compared with the output of the intake air temperature sensor. However, the same effect can be obtained by comparing the output of the EGR temperature sensor with a specified value corresponding to a specified temperature.

In the present invention, the same effect can be obtained by attaching the EGR temperature sensor to a piping at the inlet or the outlet side of the EGR valve instead of attaching it to the EGR valve.

In the present invention, the same effect can be obtained by attaching the EGR temperature sensor to the intake air passage such as the throttle body, the surge tank and so on, instead of attaching it to the intake manifold.

In the above-mentioned embodiments, the EGR abnormality determining condition is determined by using the engine revolution number and the pressure in the intake manifold. However, the same effect can be obtained by detecting directly a pressure of the EGR valve or by using a plunger stroke sensor to detect a pressure of the EGR valve.

Obviously, numerous modifications and variations of the present invention are possible in light of the above teachings. Therefore, it is to be understood that within the scope of the appended claims, the invention may be practiced otherwise than as specifically described herein.

What is claimed is:

1. A detecting device for detecting abnormality in an EGR system which comprises:
   - an EGR valve disposed in an EGR passage to control a flow rate of recirculated exhaust gas,
   - a first temperature sensor disposed in said EGR passage to detect the temperature of the same,
   - a second temperature sensor disposed in the air-intake passage of an engine,
   - EGR abnormality determining zone discriminating means to discriminate a specified operational zone in an operable area for the engine in which recirculation of the exhaust gas is controlled by said EGR valve, and
   - abnormality determining means to determine abnormality in the EGR system depending on a value obtained by comparison of the output of said first and second temperature sensor in said specified operational zone.

2. The detecting device for detecting abnormality in an EGR system according to claim 1, wherein said second temperature sensor is disposed in the intake manifold of said air intake passage or a surge tank.

3. The detecting device for detecting abnormality in an EGR system according to claim 1, which further comprises display means for displaying an abnormality in said EGR system when the output of said first temperature sensor is lower by a predetermined value than the output of said second temperature sensor.

4. A detecting device for detecting abnormality in an exhaust gas recirculation (EGR) system, comprising:
   - an engine provided with an EGR system comprising an EGR valve to control a flow rate of exhaust gas to be recirculated to an air intake pipe;
   - an EGR temperature sensor disposed in an exhaust gas recirculation passage in said EGR system;
   - abnormality determining condition detecting means which measures a time period in which an operational condition of said engine is within a specified zone which stabilizes a recirculation of the exhaust gas in said EGR system, and stops the measurement of said time period when said operational condition is out of said specified zone and this outzone condition is within a first predetermined time, and which detects whether a time obtained by accumulation of measurement exceeds a second predetermined time; and
   - abnormality determining means to detect abnormality in said EGR system on the basis of an output of said EGR temperature sensor when a detection output is received from said abnormality determining condition detecting means.

5. The abnormality detecting device for detecting abnormality in an EGR system according to claim 4, wherein said abnormality determining means detects an abnormality in said EGR system depending on a difference between the output of said EGR temperature sensor and the output of an intake air temperature sensor attached to an intake manifold or a surge tank which constitutes said air intake pipe.

6. A detecting device for detecting abnormality in an exhaust gas recirculation (EGR) system, comprising:

an engine provided with an EGR system comprising an EGR valve to control a flow rate of exhaust gas to be recirculated to an air intake pipe;

an EGR temperature sensor disposed in an exhaust gas recirculation passage in said EGR system;

abnormality determining condition detecting means which measures a time period in which an operational condition of said engine is within a specified zone which stabilizes a recirculation of the exhaust gas in said EGR system, and stops the measurement of said time period when said operational condition is out of said specified zone and this outzone condition is within a first predetermined time, and which detects the fact that a time obtained by accumulation of measurement exceeds a second predetermined time; and abnormality determining means to detect abnormality in said EGR system on the basis of an output of said EGR temperature sensor when a detection output is received from said abnormality determining condition detecting means.

7. The abnormality detecting device for detecting abnormality in an EGR system according to claim 6, wherein said abnormality determining means detects an abnormality in said EGR system depending on a difference between the output of said EGR temperature sensor and the output of an intake air temperature sensor attached to an intake manifold or a surge tank which constitutes said intake pipe.

* * * * *